US005941573A

United States Patent [19]

Yordinsky

[11] Patent Number: 5,941,573

[45] Date of Patent: Aug. 24, 1999

[54] GREETING CARD

[76] Inventor: Sol Yordinsky, 23 Dongan Hills Ave., Staten Island, N.Y. 10306

[21] Appl. No.: 09/037,571

[22] Filed: Mar. 10, 1998

[51] Int. Cl.[6] ..... B42D 15/00

[52] U.S. Cl. ..... 283/117

[58] Field of Search ..... 283/117, 61, 62, 283/56, 91; 40/124.1; 446/147

[56] References Cited

U.S. PATENT DOCUMENTS 5,551,730 9/1996 Barreca et al. ..... 283/117
5,622,384 4/1997 Bradley ..... 283/117 X
5,687,992 11/1997 Finkelshteyn ..... 283/117
5,743,035 4/1998 Bradley et al. ..... 283/117 X

*Primary Examiner*—Willmon Fridie, Jr.
*Attorney, Agent, or Firm*—Goldstein & Canino

[57] ABSTRACT

A greeting card, comprising a front panel, two side panels, and a rear reflecting panel. An image panel, bearing a translucent or transparent image, is centrally located on the front panel. The front panel has a front panel bottom where the rear reflecting panel is attached, forming an acute angle therewith for reflecting ambient light toward the image panel. The side panels extend substantially perpendicular to the front panel to make the greeting card free standing. The rear reflecting panel fixes to the side panels with a pair of tabs and slots for fixing the relative positions of the front panel, side panels, and the rear reflecting panel.

10 Claims, 4 Drawing Sheets

GREETING CARD

BACKGROUND OF THE INVENTION

The invention relates to a greeting card. More particularly, the invention relates to a greeting card having a front panel which contains a translucent image, and further having a rear reflecting panel which is angled toward the front panel for reflecting light toward the inside panel, for enhancing the visibility of the translucent image.

Standard greeting cards are made of cover stock, vertically folded in a book-like manner to form a front and rear panel, wherein pictures and text are imprinted on each of the panels to convey a message. Typically though, the card is opaque, and thus only light that reflects off the printing on the card surface is seen by the viewer.

Sometimes greeting cards are provided with a semi-transparent sheet bearing an image. Usually this sheet is laminated onto opaque card stock. Thus, the semi-transparent sheet merely adds dimension to the greeting card image. No additional light is collected by the card stock to enhance or back-light the image on the semi-transparent sheet.

U.S. Pat. No. 286,642 to Schwartz, discloses a picture card which has a front panel which has a transparent foreground image, and then has two or more rear panels which add further background details to the image. Thus, the additional rear panels have further images which form the middle ground and background to create a complete picture. However, the rear panels form a closed loop with the front panel, and thus the rear panels do not reflect any overhead light toward the front panels. Therefore, substantial lighting must be present in front of the card to view the complete image formed by the three panels.

U.S. Pat. No. 1,809,688 to Goudey et al. discloses a display sign. The sign has a front panel which has cut-out letters having different colored material within. A back panel is provided to reflect different colored light through the cut-out letters. Goudey is a fairly complicated construction, requiring the manipulation of nine panels and eight tabs in order to assemble.

U.S. Pat. No. 1,769,377 to Lindsey discloses a showcard which has various cut-out images on its front surface. Lindsey also is complex in construction, requiring the manipulation of several panels and numerous tabs to assemble. The final product is intended to be mounted to a vertical wall, and thus is not free-standing.

While these units may be suitable for the particular purpose employed, or for general use, they would not be as suitable for the purposes of the present invention as disclosed hereafter.

SUMMARY OF THE INVENTION

It is an object of the invention to produce a greeting card having a front panel which has a transparent or translucent image, whose appearance is further enhanced by additional light reflected toward the image. Accordingly, a rear panel is provided behind the front panel, which is angled toward the image to reflect ambient light toward the image to increase the radiance and brilliance of said image.

It is another object of the invention to produce a greeting card which is free standing. Accordingly, a pair of side panels are attached to the front panel, and are configured to extend substantially perpendicular to the front panel, to allow the front panel to stand vertically upon a flat horizontal surface.

It is a further object of the invention that the greeting card is simple in construction, so that it may be easily assembled by its intended user. Accordingly, a four panel construction is provided, which fully assembles into a stable free-standing greeting card by simply inserting two tabs into two slots.

The invention is a greeting card, comprising a front panel, two side panels, and a rear reflecting panel. An image panel, bearing a translucent or transparent image, is centrally located on the front panel. The front panel has a front panel bottom where the rear reflecting panel is attached, forming an acute angle therewith for reflecting ambient light toward the image panel. The side panels extend substantially perpendicular to the front panel to make the greeting card free standing. The rear reflecting panel fixes to the side panels with a pair of tabs and slots for fixing the relative positions of the front panel, side panels, and the rear reflecting panel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
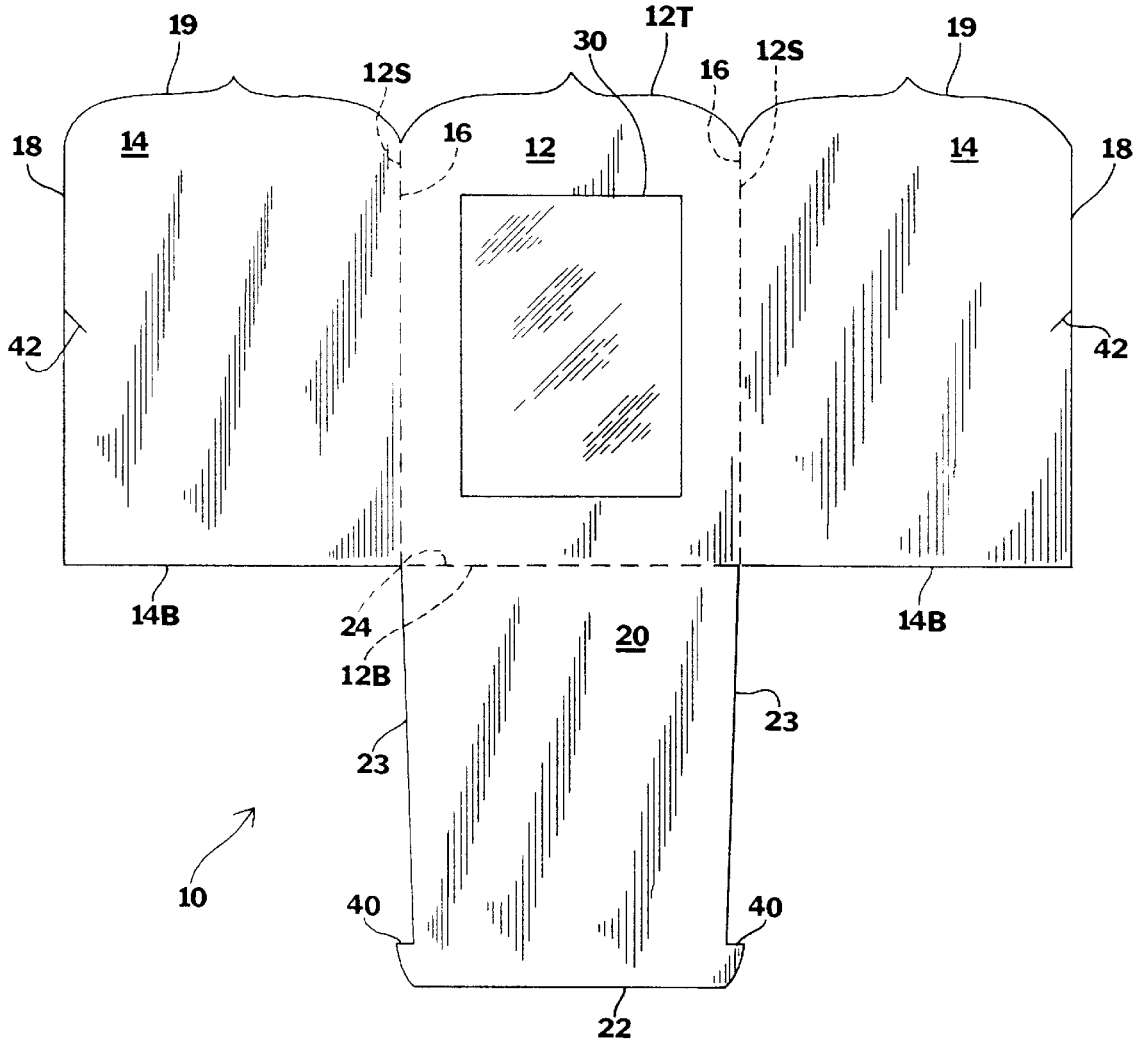
FIG. 1 is a top plan view of the greeting card, fully unassembled and laid flat.

FIG. 1 illustrates a greeting card 10 comprised of a unitary sheet of material, which is typically paper or card stock. The greeting card 10 is illustrated laid flat.

The greeting card 10 comprises a front panel 12 having a front panel top 12T, a front panel bottom 12B, and two front panel sides 12S. The greeting card 10 also comprises a pair of side panels 14, each having a side panel bottom 14B, a side panel inside 16, a side panel outside 18, and a side panel top 19. The greeting card also has a rear reflecting panel 20 having a rear reflecting panel top 22, rear reflecting panel sides 23, and a rear reflecting panel bottom 24.

Connectivity of the various panels is described as follows. The side panels 14 adjoin the front panel 12 wherein the front panel sides 12S meet the side panel inside 16 of each side panel 14. The rear reflecting panel 20 adjoins the front panel 12 wherein the front panel bottom 12B meets the rear reflecting panel bottom 24.

Preferably, to promote unitary construction and simplified assembly, the front panel sides 12S and side panel insides 16 simply are fold lines between the front panel 12 and side panels 14. In addition, it is preferable that the front panel bottom 12B and rear reflecting panel bottom 24 also is simply a fold line between the front panel 12 and rear reflecting panel 20.

The front panel 12 has an image panel 30 which is translucent or transparent, and is centrally located on the front panel 12. The remainder of the front panel 12, side panels 14, and rear reflecting panel 16 is made of an opaque card stock material.

The rear reflecting panel 20 has a pair of tabs 40 extending from the rear reflecting panel sides 23, adjacent to the rear reflecting panel top 22. The side panels 14 each have a slot 42 located on the side panel outside 18 substantially midway between the side panel bottom 14B and side panel top 19. The slots 42 are angled downward so they point directly at the junction of the side panel bottom 14B and side panel inside 16. In addition, on each side panel 14, the distance between the slot 42 and the junction of the side panel bottom 14B and side panel inside 16 is equal to the distance between the rear reflecting panel bottom 24 and rear reflecting panel top 22, for reasons which will be apparent immediately hereinafter.

Figure 2:
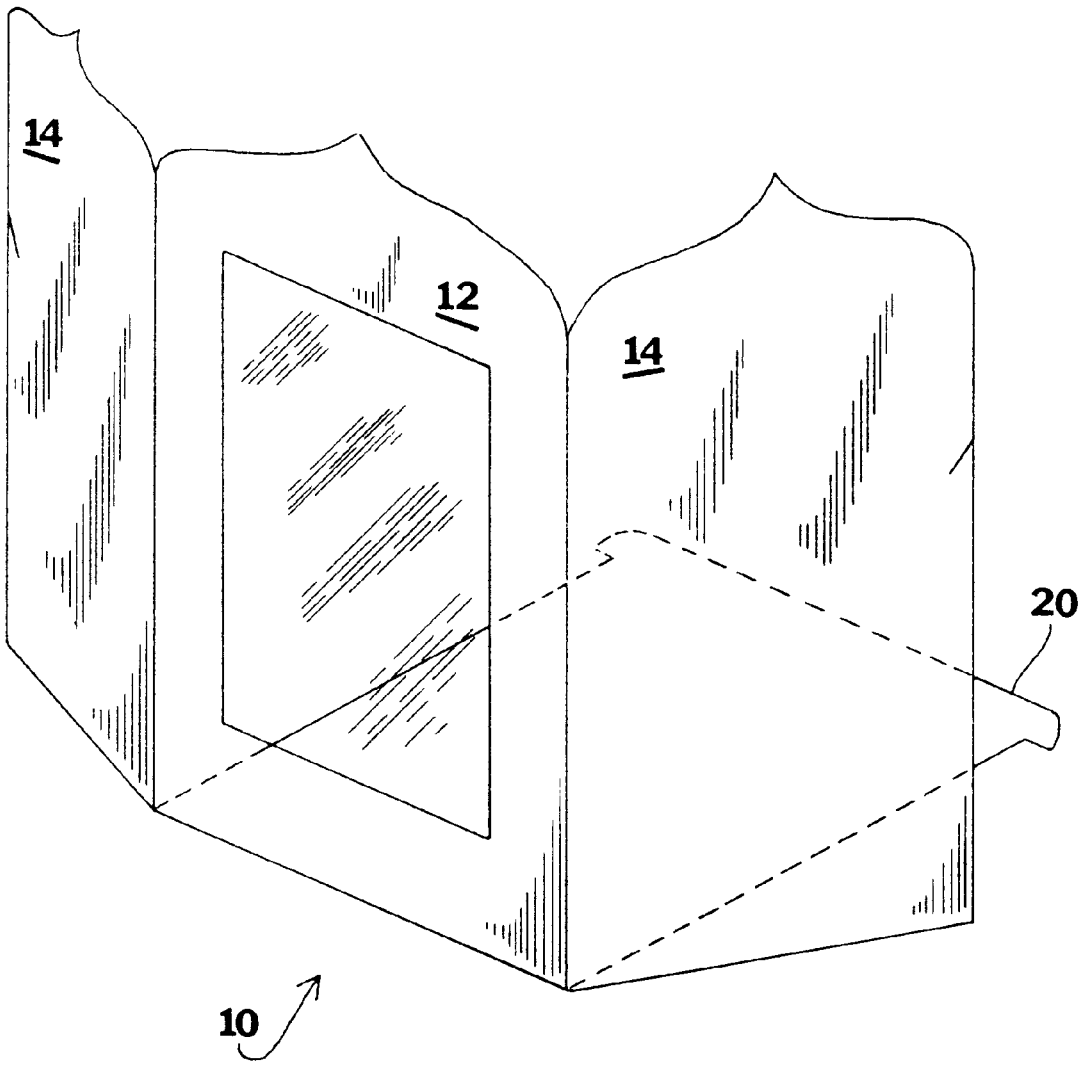
FIG. 2 is a diagrammatic perspective view of the greeting card, wherein the rear reflecting panel is folded with respect to the front panel, and wherein the side panels are about to be folded with respect to the front panel.

FIG. 2 illustrates a first assembly step of the greeting card 10, wherein the rear reflecting panel 20 has been folded with respect to the front panel 12, and wherein the side panels 14 have been partially folded with respect to the front panel 12.

Figure 3:
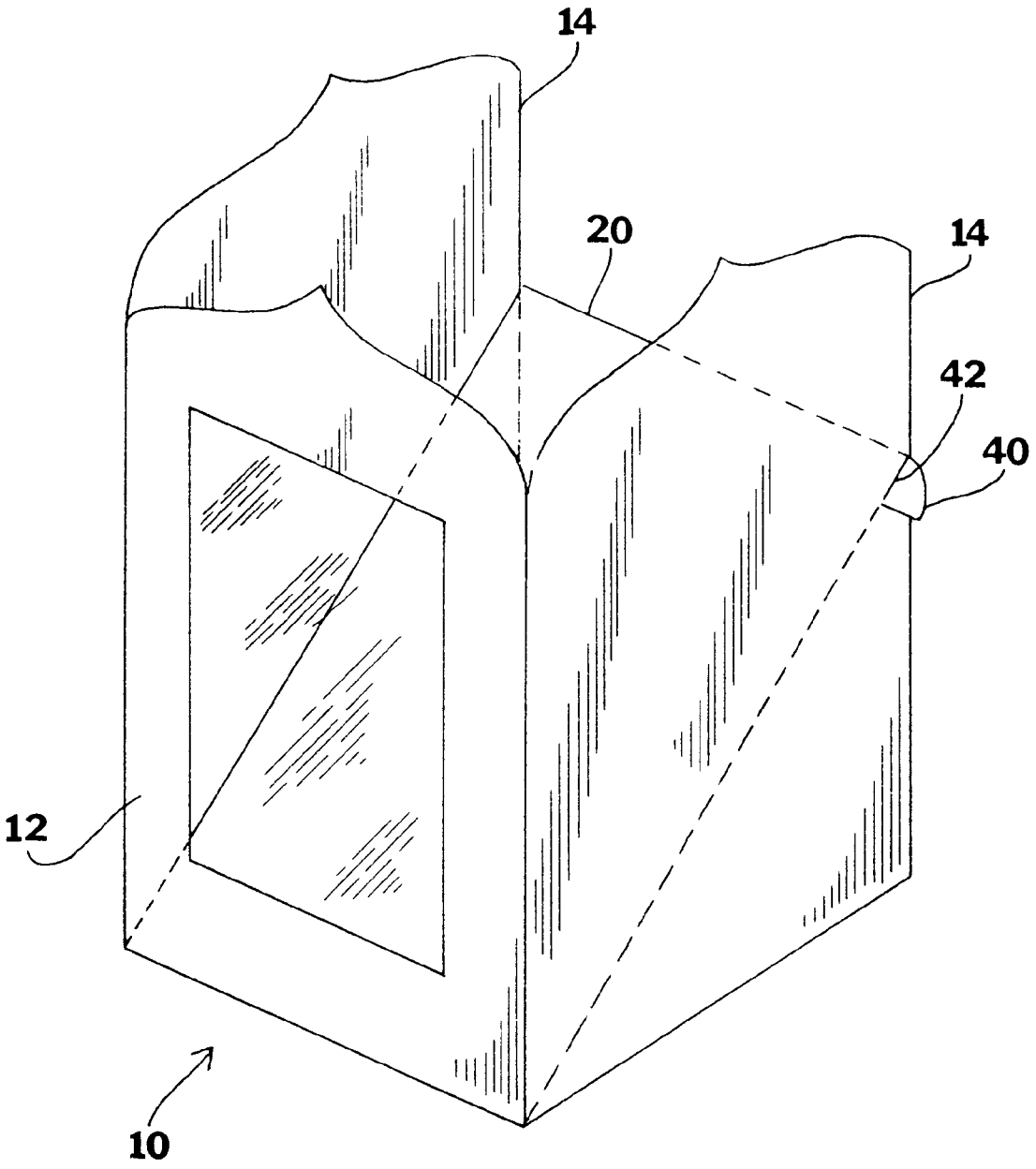
FIG. 3 is a diagrammatic perspective view of the greeting card, wherein the side panels have been folded substantially perpendicular to the front panel to make the greeting card free standing, and wherein the rear reflecting panel has formed an acute angle with the front panel and has been locked in place by inserting its tabs into slots in the side panels.

In FIG. 3, the greeting card 10 has been fully assembled, wherein the rear reflecting panel 20 has been folded an acute angle with respect to the front panel 12, and wherein the side panels 14 have been folded substantially perpendicular to the front panel 12 to meet the rear reflecting panel 20.

The tabs 40 of the rear reflecting panel 20 have been inserted into the slots 42 of the side panels 14 to fix the relative position of the rear reflecting panel 20 with respect to the side panel 14, and also to fix the relative positions of the front panel 12, rear reflecting panel 20 and side panels 14.

Figure 4:
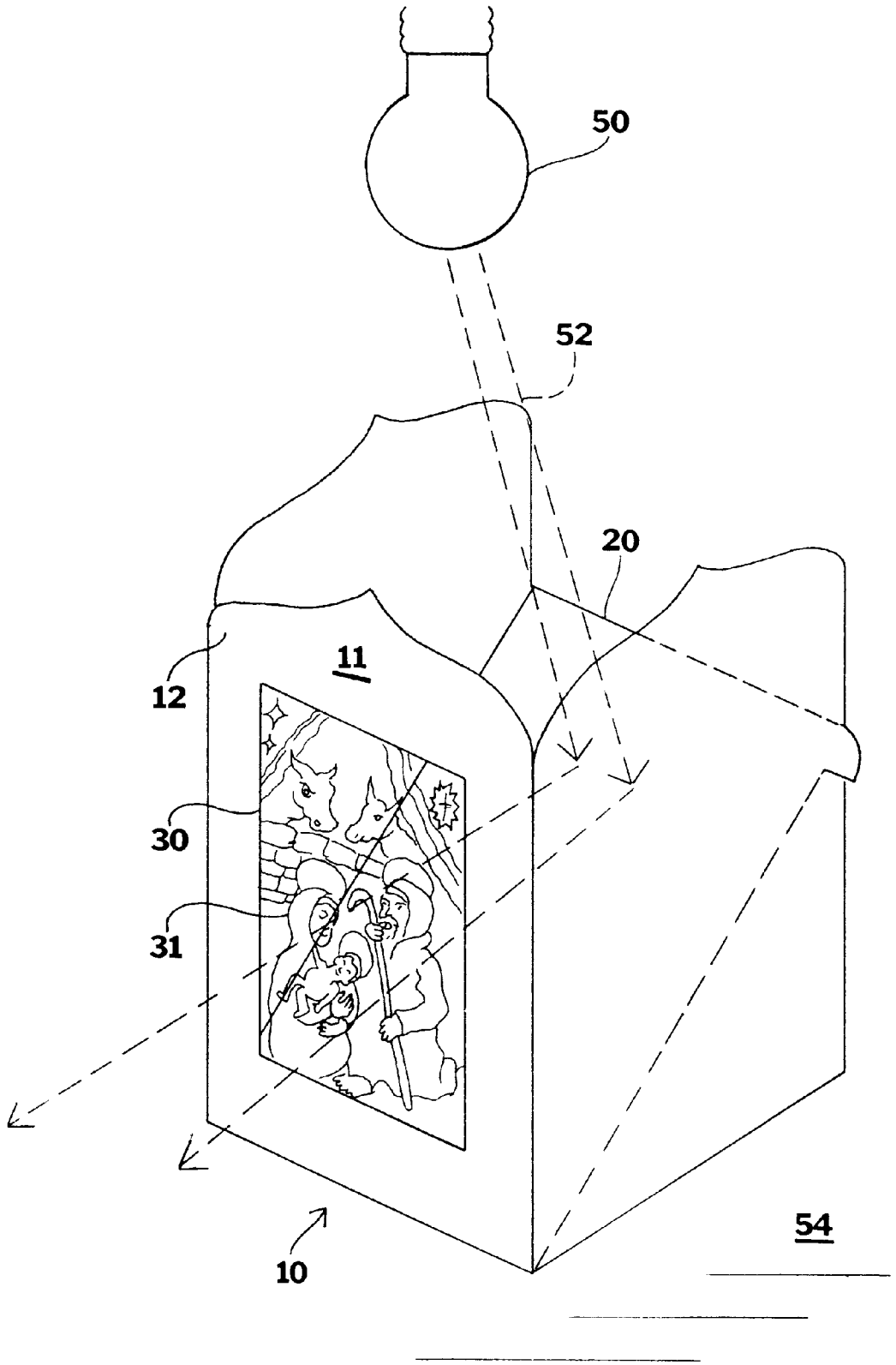
FIG. 4 is a diagrammatic perspective view, illustrating the assembled greeting card, wherein overhead light is being reflected by the rear reflecting panel toward the front panel, enhancing the appearance of the image on the front panel.

FIG. 4 illustrates the fully assembled greeting card 10 in use. The front panel 12, including the image panel 30, has a front surface 11. An overhead light 50 is propagating light 52 downward, which is reflected by the rear reflecting panel 20 onto the image panel 30, for enhancing the appearance thereof to a viewer who is viewing the front panel by standing before the front surface 11.

Typically the image panel 30 is made of a transparent, glossy material such as mylar. The image panel 30 has an image 31 which is preferably a colorful image printed opposite the front surface 11. In this manner, the front surface 11 of the image panel 30 remains glossy, and the colorful image is projected from behind by the light reflected by the rear reflecting panel 20. The viewer first sees a high-gloss non-print surface when gazing upon the front surface 11.

In conclusion, herein is presented a greeting card which has a front panel which bears a transparent image panel. A rear reflecting panel is attached behind the front panel, for reflecting ambient light toward the image panel, for enhancing the appearance of the colorful image printed thereupon.

What is claimed is:

1. A greeting card, comprising:

a front panel, having a front panel bottom and front panel sides, the front panel further having an image panel which is translucent;

a rear reflecting panel, having a rear reflecting panel bottom and rear reflecting panel sides, the rear reflecting panel connected to the front panel wherein the front panel bottom adjoins the rear reflecting panel bottom, the rear reflecting panel forming an acute angle with respect to the front panel so that the rear reflecting panel reflects ambient light from above the greeting card toward the image panel;

a pair of side panels, the sides panels each having a side panel inside, the side panels connected to the front panel wherein each side panel inside is connected to one of the front panel sides; and a fixing mechanism for attaching the rear reflecting panel to the side panels and thereby fixing the relative position of the side panels, the front panel, and the rear reflecting panel.

2. The greeting card as recited in claim 1, wherein the fixing mechanism further comprises a slot in each of the side panels, and a pair of tabs in the rear reflecting panel.

3. The greeting card as recited in claim 2, wherein the rear reflecting panel has a rear reflecting panel top and the side panels each have a side panel top, a side panel bottom, and a side panel outside, wherein:

the tabs extend from the rear reflecting panel sides adjacent to the rear reflecting panel top; and the slots extend into the side panel outside substantially midway between the side panel top and side panel bottom.

4. The greeting card as recited in claim 3, wherein the greeting card is free standing upon the front panel bottom and the side panel bottoms.

5. The greeting card as recited in claim 4, wherein the slots extend downward toward a junction of the side panel bottom and side panel inside, and wherein a distance between the rear reflecting panel top and rear reflecting panel bottom is equal to a distance between the slot on one of the sides and the junction of that side panel bottom and side panel inside.

6. The greeting card as recited in claim 5, wherein the image panel is centrally located on the front panel, and wherein the remainder of the front panel, side panel, and rear reflecting panel is substantially opaque.

7. The greeting card as recited in claim 6, wherein the joinder of the front panel side and each side panel inside is a fold in a unitary sheet of material.

8. The greeting card as recited in claim 7, wherein the joinder of the front panel bottom and the rear reflecting panel bottom is another fold in the unitary sheet of material.

9. The greeting card as recited in claim 8, wherein the side panels are folded substantially perpendicular to the front panel to meet the rear reflecting panel, the greeting card rests upon an even surface by resting upon the front panel bottom and the side panel bottoms.

10. A greeting card, consisting essentially of:

a front panel, having a front panel bottom and front panel sides, the front panel further having an image panel which is translucent;

a rear reflecting panel, having a rear reflecting panel bottom and rear reflecting panel sides, the rear reflecting panel connected to the front panel wherein the front panel bottom adjoins the rear reflecting panel bottom, the rear reflecting panel forming an acute angle with respect to the front panel so that the rear reflecting panel reflects ambient light from above the greeting card toward the image panel; and a pair of side panels, the sides panels each having a side panel inside, the side panels connected to the front panel wherein each side panel inside is connected to one of the front panel sides; and a fixing mechanism for attaching the rear reflecting panel to the side panels and thereby fixing the relative position of the side panels, the front panel, and the rear reflecting panel.

* * * * *